US005152495A

United States Patent [19]

Jacinto et al.

[11] Patent Number: 5,152,495

[45] Date of Patent: Oct. 6, 1992

[54] UMBRELLA ANCHORING MECHANISM

[76] Inventors: Manuel A. Jacinto; Pablo W. Concepcion, both of 235 SW. Le Jeune Rd., Miami, Fla. 33134

[21] Appl. No.: 762,826

[22] Filed: Sep. 19, 1991

[51] Int. Cl.[5] ..... E04H 15/28; A45F 3/44

[52] U.S. Cl. ..... 248/545; 52/157; 135/98; 248/156; 248/530; 248/532

[58] Field of Search ..... 248/156, 530, 532, 533, 248/545, 96, 522; 52/157, 155, 156; 135/98, 99, 114, 118

[56] References Cited

U.S. PATENT DOCUMENTS

| | | | |
|---|---|---|---|
| 809.879 | 1/1906 | Wiltse | 135/114 X |
| 906.438 | 12/1908 | Lemerand | 52/157 X |
| 1,736.177 | 11/1929 | Snook | 248/530 X |
| 1,907.811 | 5/1933 | Hollos | 52/157 X |
| 2,580.948 | 1/1952 | Pancake | 248/156 X |
| 3,011.597 | 12/1961 | Galloway et al. | 52/156 X |
| 4,850.564 | 7/1989 | Padin | 248/533 |
| 4,920.897 | 5/1990 | Reed et al. | 248/156 X |

*Primary Examiner*—Carl D. Friedman
*Assistant Examiner*—Derek J. Berger

[57] ABSTRACT

A mechanism for anchoring umbrellas that includes a tubular outer member and a helical assembly at the lower end that is driven into the ground through manually imparted rotation through the use of a gear box and handle or battery powered electric motor. Stabilizing members protrude into the ground by the action of a releasable spring. The spring acts on an inner shaft that is co-axially housed within an outer tubular member. The inner shaft is rigidly mounted at its lower end to a platform member from which the stabilizing members are pivotally mounted. The stabilizing members protrude outwardly and snuggly through angular openings preventing the sand or soil from entering.

16 Claims, 3 Drawing Sheets

UMBRELLA ANCHORING MECHANISM

BACKGROUND OF THE INVENTION

1. Field of the Invention

The present invention relates to umbrella anchoring mechanisms, and more particularly, to such mechanism that permit the removable attachment to the ground of umbrellas to withstand wind or other forces that tend to remove it from its location.

2. Description of the Related Art

The typical user buries the lowermost end of the shaft of the beach umbrella in the sand and not infrequently these umbrellas fly away from the intended location when sufficient wind blows. One attempt to solve this problem is disclosed in U.S. Pat. No. 4,850,564 issue to Padin in 1989. The patented device requires the use of a stabilizing base member 42 and pin members 52 and 53 to provide the necessary torque to drive helical assembly into the ground. A user has to bend over to kneel down to perform this manual task.

Another related reference corresponds to U.S. Pat. No. 1,736,177 issued to Snook in 1929. This patent discloses a device that utilizes a helical assembly but it has no means of readily driving it into the ground.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a mechanism for anchoring an umbrella to the ground and to provide stabilizing members that further secure it to the ground at additional anchorage points.

It is another object of this invention to provide such a mechanism that can be readily used by a user without requiring him to bend down.

It is still another object of the present invention to provide a mechanism for anchoring umbrellas that is easy to operate.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figures 1, 1A, 1B:
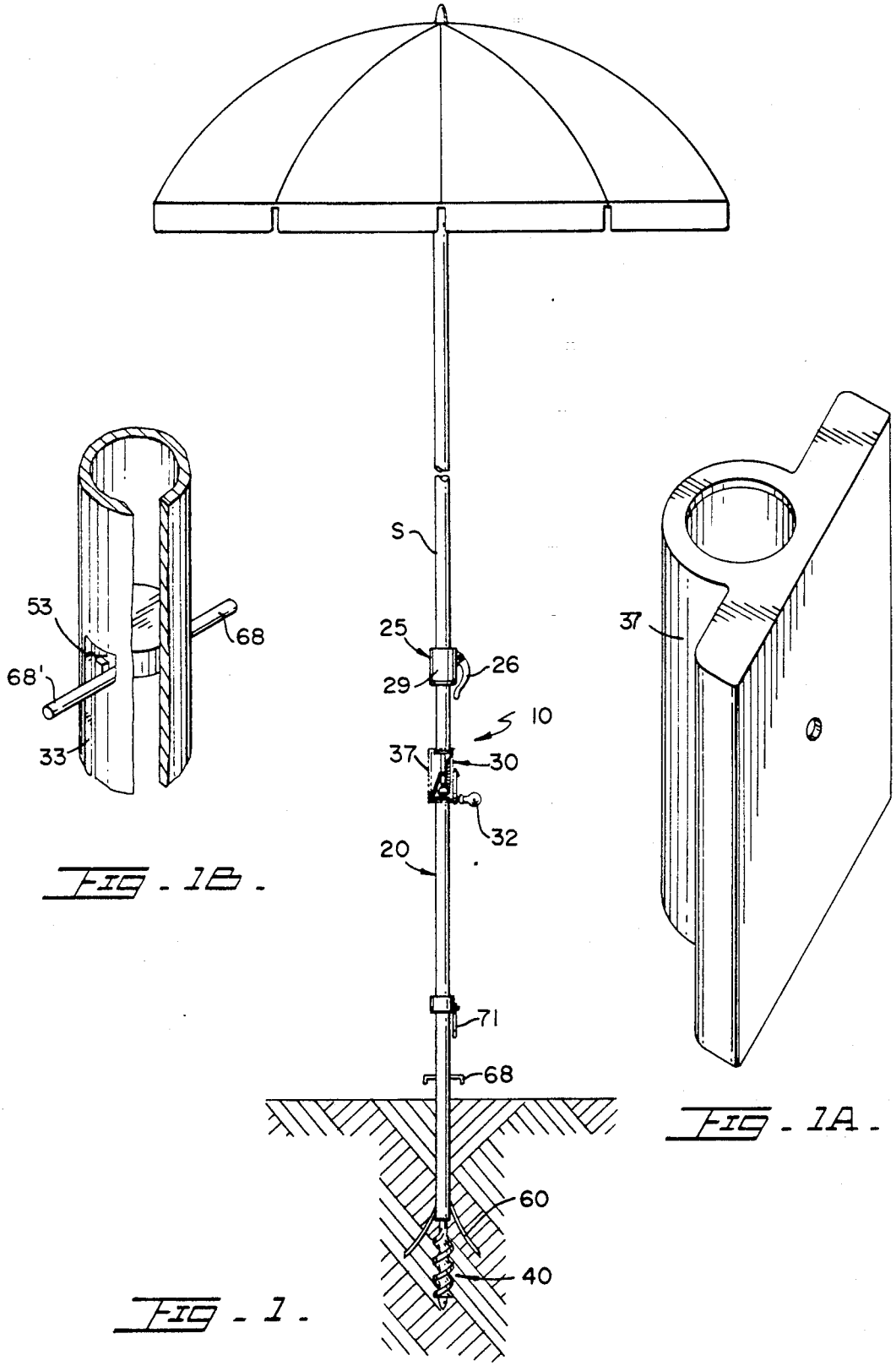
FIG. 1 represents a side elevational view of the shaft of an umbrella incorporating the present invention.
FIG. 1A illustrates the housing for the gear assembly not shown in FIG. 1.
FIG. 1B represents an alternate embodiment for the retaining means used to keep the spring member in the compressed state.

Referring now to the drawings, it can be observed that the present invention is generally referred to with numeral 10 and it comprises elongated outer tubular member 20 that has an upper end and a lower end. The upper end removably supports shaft S of an umbrella. The lower end is buried into the ground or sand.

Shaft holding assembly 25 is rigidly mounted at the upper end of tubular member 20. Assembly 25 includes lever 26 which is pivotally mounted to cylindrical cup 29 that has sufficiently large diameter to receive shaft S. Lever 26 commonly comes in friction with shaft S holding it in place until released.

Figure 2:
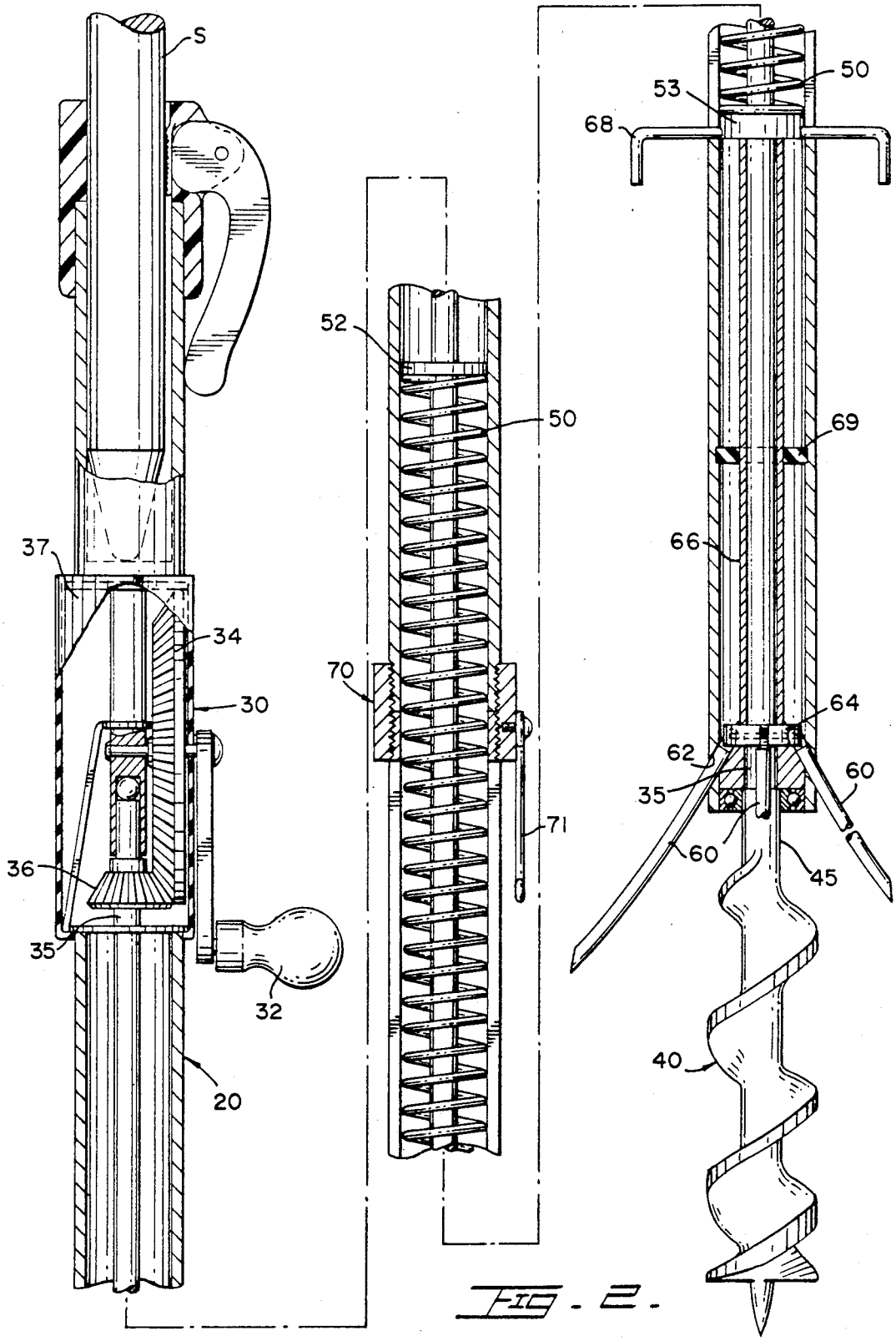
FIG. 2 shows cross-sectional views of three portions of the umbrella shown in FIG. 1.

Below assembly 25 there is gear assembly 30. Gear assembly 30 includes handle 32 which is rigidly attached to large gear 34 as best seen in FIG. 2. Housing 37 covers the components of gear assembly 30 thereby protecting them from the elements. Large gear 34 is in meshed engagement with smaller gear 36 which in turn is rigidly mounted to the upper end of inner shaft 35. Inner shaft 35 is coaxially disposed within outer tubular member 20 and extends longitudinally throughout the entire remaining length to protrude somewhat beyond the lower end of outer tubular member 20. The protruding end of shaft 35 comes in rigid engagement with shaft 45 of helical assembly 40. In this manner, the rotational force transmitted to handle member 32 is transmitted to helical assembly 40 tending to drive mechanism 10 in the ground or sand.

To provide further structural stability to the mechanism stabilizing members 60 protrude outwardly through angled openings 62 that are located substantially adjacent to the lower end of tubular member 20. Stabilizing members 60 have a slight arcuate shape and they are preferably made out of a resilient material. Stabilizing members 60 are pivotally mounted to platform 64 which slidably travels within outer tubular member 20 and is attached to the lower end of inner tubular member 66. Inner tubular member 66 is rigidly mounted to platform member 64 and to cap member 53 so that a user can pull on pin 68 to compress spring member 50. Spring member 50 stays in the compressed by retaining assembly 70 which includes hook member 71 that engages with pin 68. When released, the action of spring member 50 against stopper member 52. Stopper member 52 is rigidly mounted inside outer tubular member 20. Spring member 50 acts on cap member 53 pushing inner tubular member 66 down which in turn causes platform 64 to move down. Stabilizing members 60 are pushed through angled openings 62 slightly deforming members 60 as they go through openings 62. Since stabilizing members 60 are resilient, they recover their slightly arcuate shape as they protrude through angle openings 62. In the preferred embodiment, stainless steel or plastic is used for stabilizing members 60. Their function of members 60 is to act somewhat like a tripod to provide additional stability to the structure.

At the lower end of outer tubular member 20 ball-bearing assembly 25 receives helical shaft 45 of helical assembly 40. This permits the rotation of the latter without introducing any sand in the interior of the lower portion of tubular member 20 where platform 64 travels up and down. This travel is limited by the compression of spring 50. Seal member 69 is rigidly in position within outer tubular member 20 at a point separated from the lower end of tubular member 20. Sealing member 69 impedes the passage of any particles that may have made it through angle openings 62. Angle openings 62 are designed so that stabilizing members 60 snuggly fit through them and with the characteristic resiliency of stabilizing members 60 recuperate their initial form thereby preventing the introduction of any foreign particles.

An alternate embodiment for substituting retaining assembly 70 is shown in FIG. 1B. As it can be seen, slot 33 ends at its upper end with substantially the shape of an inverted "J". Pin 68 then can be securely lodged in position 68' thereby keeping spring member 50 in the compression state.

In operation, a user positions helical assembly 40 on the spot (typically at the beach in a sandy area) where he or she wants to mount the umbrella. He or she starts rotating handle 32 which causes helical assembly 40 to be driven in. Then, he or she releases pin 68 from position 68' which permits stabilizing members 60 to protrude outwardly through angled openings 62.

Figure 3:
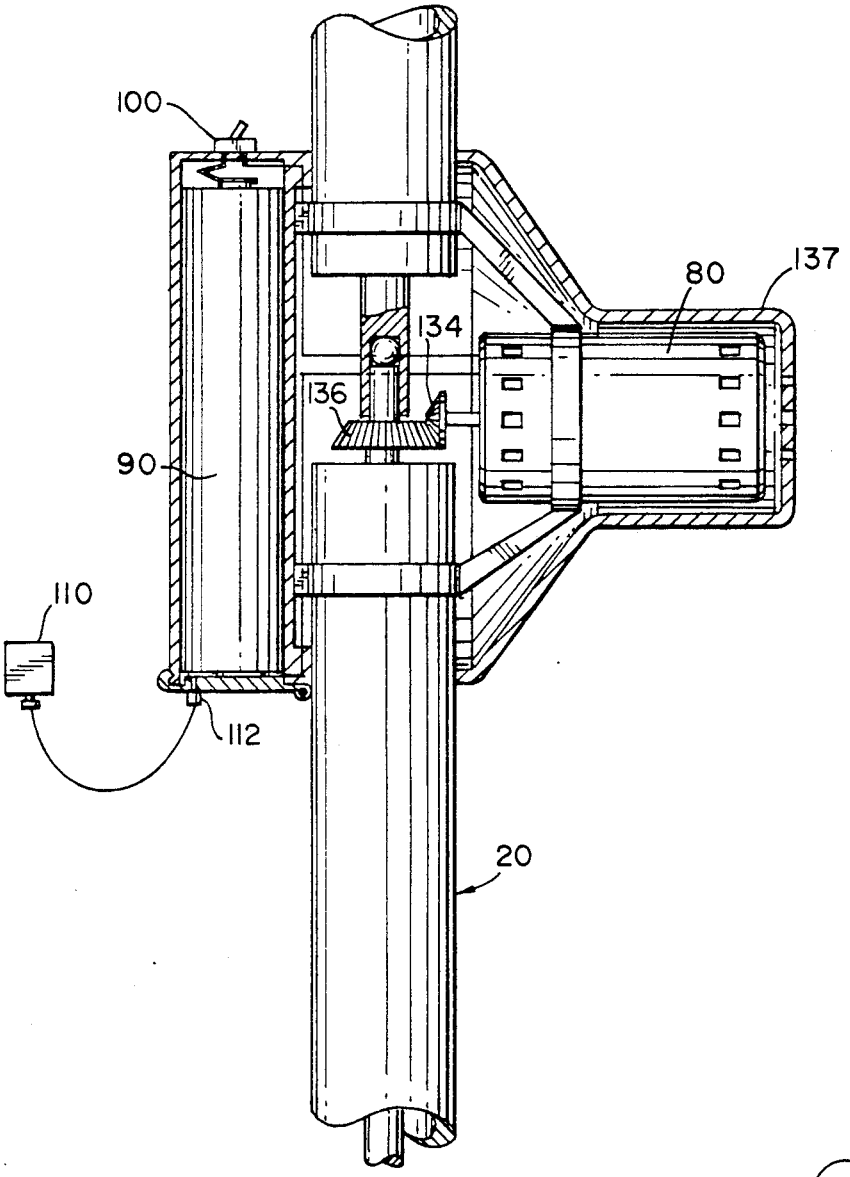
FIG. 3 shows an alternate embodiment incorporating an electrically powered year assembly.
Figure 4:
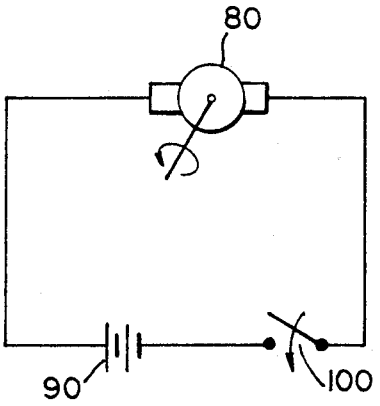
FIG. 4 represents a circuit diagram of the electrically powered gear assembly.

An alternate embodiment is shown in FIG. 3 where the present invention is powered by electric motor member 80 which is in meshed engagement through pinion gear 134 with gear member 136 rigidly mounted to inner shaft member 35. Battery assembly 90 is connected to electric motor member 80 through switch member 100 that selectively interrupts the electric circuit. Battery assembly 90 is preferably of the rechargeable type. Recharging device 110 is removably connected through jack member 112.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A mechanism for anchoring umbrellas having a shaft, comprising:

A an elongated outer tubular member having an upper end and a lower end and further including a plurality of angled openings at said lower end;

B means for removably holding said shaft mounted at said upper end;

C an inner shaft coaxially disposed within said elongated outer tubular member and extending substantially along the entire length of said outer tubular member and said inner shaft further including two ends and one of said ends of said inner shaft member including a gear termination;

D gear means for imparting a rotational force to said gear termination;

E a helical assembly rigidly mounted to the other end of said inner shaft member so that said helical assembly is driven into the ground when said gear means impart a rotational force to said inner shaft; and F spring-loaded stabilizing means for providing structural stability to said mechanism and further including a plurality of stabilizing members that protrude from the interior of said outer tubular means snuggly passing through said angled openings and said stabilizing members being made out of a resilient material.

2. The mechanism set forth in claim 1 wherein said spring-loaded stabilizing means includes a spring member co-axially disposed within said outer tubular member and further including pin means for compressing said spring member and retracting said stabilizing members within said outer tubular member.

3. The mechanism set forth in claim 2 further including:

G retaining means for releasably keeping said spring member in compressed state.

4. The mechanism set forth in claim 3 further including a longitudinal slot through which said pin means protrude outwardly and said retaining means includes a termination of said slot as an invert "J" at the end closest to said upper end of said outer tubular member.

5. The mechanism set forth in claim 4 wherein said gear means includes electric motor means for imparting said rotational force.

6. The mechanism set forth in claim 3 wherein said retaining means includes a hook member pivotally mounted to said outer tubular member so that said hook member cooperatively engages with said pin means to releasably keep said spring member in compressed state.

7. The mechanism set fourth in claim 6 wherein said gear means includes electric motor means for imparting said rotational force.

8. The mechanism set forth in claim 3 further including platform means for pivotally supporting said stabilizing members and said platform means adapted to travel within said outer tubular member.

9. The mechanism set forth in claim 8 further including means for sealing the interior of said outer tubular member between said upper end of said outer tubular member and said angled openings and substantially adjacent to the latter.

10. The mechanism set forth in claim 9 wherein said gear means includes electric motor means for imparting said rotational force.

11. The mechanism set forth in claim 5 wherein said gear means include battery means for powering said electric motor means.

12. The mechanism set forth in claim 11 wherein said battery means are of the rechargeable type.

13. The mechanism set forth in claim 7 wherein said gear means include battery means for powering said electric motor means.

14. The mechanism set forth in claim 13 wherein said battery means are of the rechargeable type.

15. The mechanism set forth in claim 10 wherein said gear means include battery means for powering said electric motor means.

16. The mechanism set forth in claim 15 wherein said battery means are of the rechargeable type.

* * * * *